United States Patent [19]

Wicks

[11] 4,037,420

[45] July 26, 1977

[54] MECHANISM FOR INSTALLATION AND REMOVAL OF A DOCK IN THE WATER

[76] Inventor: Jack W. Wicks, 1407 Soo Line Bldg., Minneapolis, Minn. 55402

[21] Appl. No.: 610,529

[22] Filed: Sept. 5, 1975

[51] Int. Cl.[2] ..... E02B 3/20

[52] U.S. Cl. ..... 61/48

[58] Field of Search ..... 61/48, 67; 114/.5 F, 114/.5 R

[56] References Cited

U.S. PATENT DOCUMENTS

| | | | |
|---|---|---|---|
| 3,283,517 | 11/1966 | Phillips | 61/48 |
| 3,397,546 | 8/1968 | Bisert et al. | 61/48 |
| 3,614,871 | 10/1971 | Nordell | 61/48 |

*Primary Examiner*—Paul R. Gilliam
*Assistant Examiner*—Alex Grosz
*Attorney, Agent, or Firm*—Wicks & Nemer

[57] ABSTRACT

A mechanism and method for installation and removal of a dock section into and from the water without the operator getting into the water including a pair of identical brackets having clamps for removably connecting the brackets to a dock section. The brackets each include a slot for releasably receiving the trunnion shafts of a float for supporting one end of the dock section upon the water to allow fixed connection of dock posts to the dock section with removal of the float.

7 Claims, 7 Drawing Figures

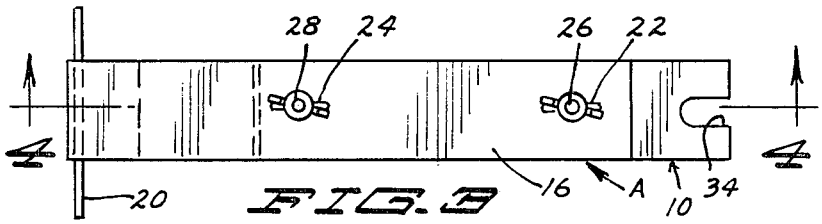
FIG. 3
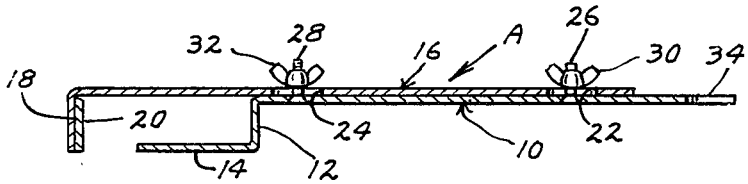
FIG. 4
FIG. 1
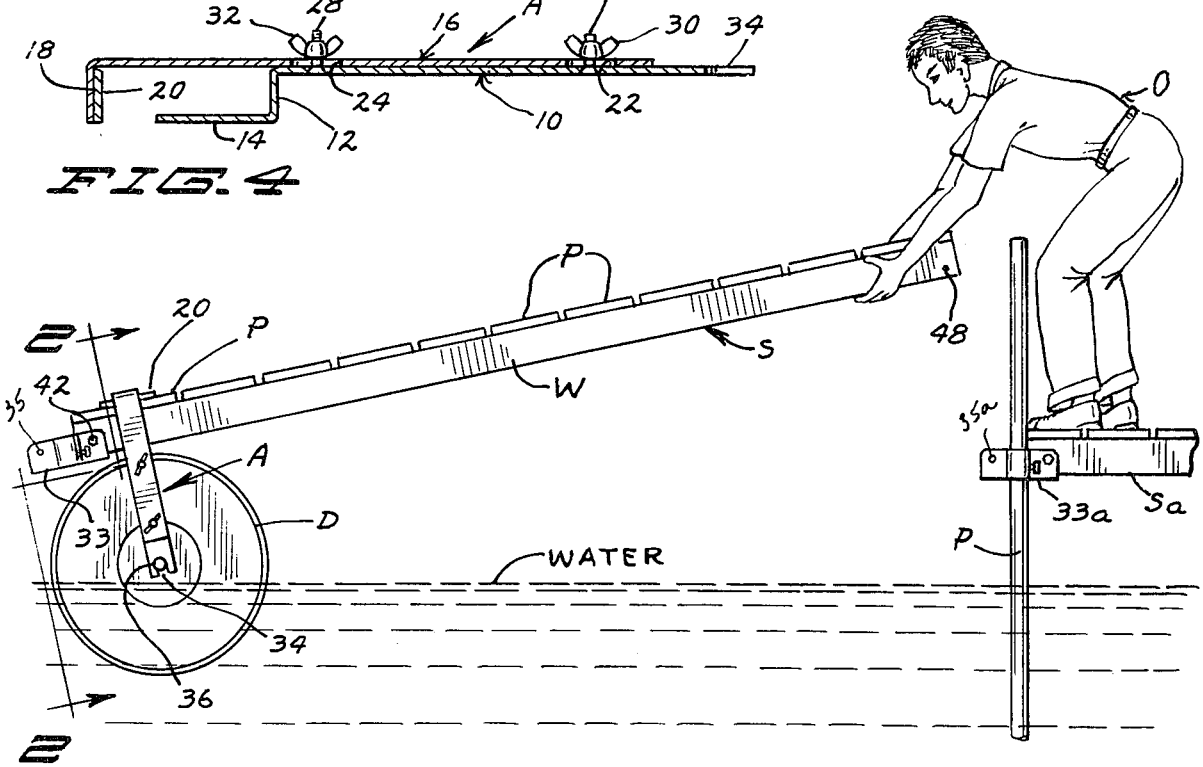
FIG. 2
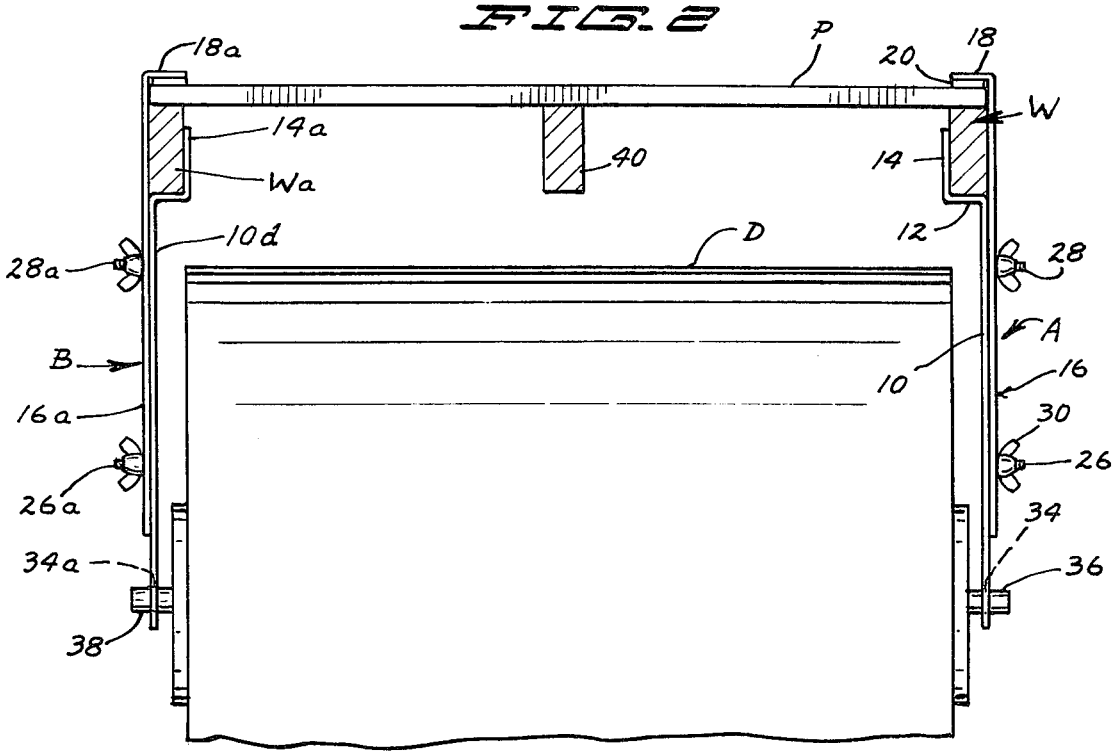

FIG. 5
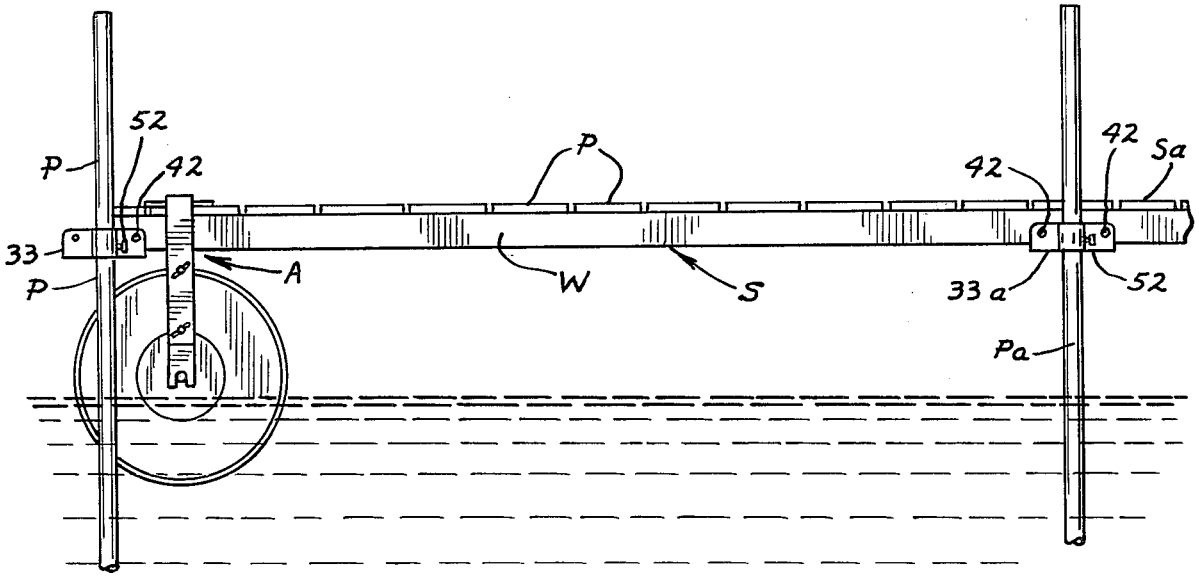
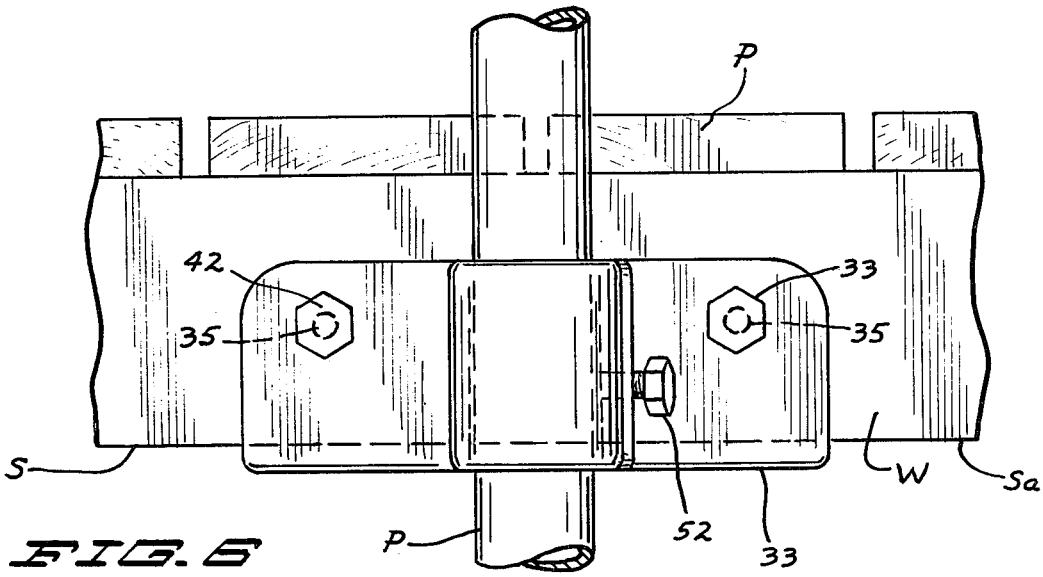
FIG. 6
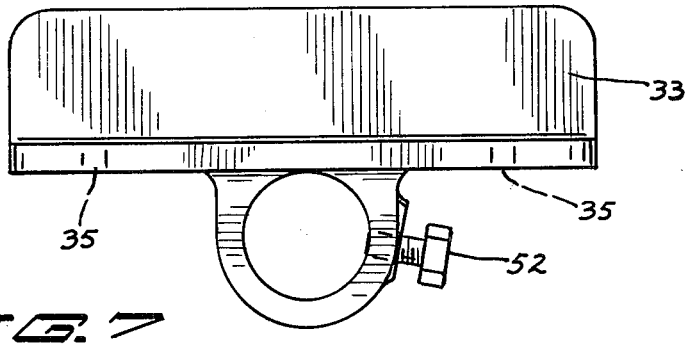
FIG. 7

MECHANISM FOR INSTALLATION AND REMOVAL OF A DOCK IN THE WATER

SUMMARY

The present invention relates to docks used primarily at the edge of a body of water and extending out into the water such as a lake as a lake and more particularly to a dock which can be installed in operable position in the water and removed from the water without getting into the water to do so.

In the northen climes, docks are generally installed in early spring and removed in late fall, the temperature of the water being relatively low in both seasons and making it quite undesirable to work in.

There is a presently known dock construction which allows a dock to be put in the water and removed from the water without getting into the water. However, such known construction includes considerable and expensive metal framing for supportng each wood dock section which framing is used to install the dock in connection with a float in the form of an aritight drum, and which framing is also the wood dock section support and therefore must remain with each dock section in the water. With the metal framing cost for each wood dock section in addition to the cost of the dock section itself, the cost of the installed dock is relatively considerable per lineal foot.

It is an object of the present invention to provide a dock construction wich may be installed in position in the water and removed without getting into the water but which does not have expensive framing members in addition to wood deck members. In any given dock one must have decking sections to walk upon no matter how the same is intalled. It is an object of the invention to provide a dock having dock sections that require one pair of identical metal brackets used to install and remove each dock section without going into the water, the one pair of brackets used to install as many sections as desired with the brackets removed from the last section with said pair of brackets being usable to install other docks.

A dock embodying the present invention is removable without getting into the water by reversing the intallation procedure as hereinafter described.

With the invention herein disclosed there are no large and bulky metal frame sections to purchase, store, or leave to the weather. The pair of brackets are relatively low in price and a simple matter to store.

In the drawing forming part of this application:

FIG. 1 is a side elevational view illustrating the initial positioning of a section of a dock in the water with brackets removably connected to the dock section embodying this invention and the use of a float in releasable connection with the brackets.

FIG. 2 is a view on the line 2—2 of FIG. 1.

FIG. 3 is a front elevational view of the bracket.

FIG. 4 is a sectional view on the line 4—4 of FIG. 3.

FIG. 5 is a side elevational view of a dock section in secured position prior to the removal of the float and brackets.

FIG. 6 is an enlarged side elevational view of a conventional dock bracket shown as connecting the ends of two dock sections.

FIG. 7 is a top plan view of the bracket of FIG. 6.

Referring to the drawings in detail, the float support in the from of temporary bracket A includes the first support portion 10 which terminates at its upper end in the right angular portion 12 which in turn terminates in the right angular portion 14 parallely disposed to the support portion 10. The portions 12 and 14 form a first half socket in the upper end of the support portion 10. Further provided is a second support portion 16 which terminates at its upper end in the right angular portion 18 to which is secured the plate 20. The portion 18 and plate 20 together with a portion of the support portion 16 form a second half socket on the upper end of the portion 16. The above mentioned first and second half sockets form a clamp for engagement with a stringer member of a dock section as hereinafter described.

The numerals 22 and 24 designate a pair of spaced slots formed in the support portion 16. Secured to the support portion 10 and extending therefrom are the spaced threaded studs 26 and 28 which extend through the slots 22 and 24, respectively.

The first and second half sockets above referred to form a clamp which receives a conventional wood "2×4" W as a stringer and dock plank P in clamping engagement by tightening the wing nuts 30 and 32 upon the studs 26 and 28, respectively. With the studs 26 and 28 extended through the slots 22 and 24 of support portion 16, the support bracket A is removably clamped upon the "2×" stringer W and plank P of the dock section at one end adjacent the conventional permanent dock bracket 33, particularly as shown in FIG. 5. The bracket 33 is formed with a hole 35 adjacent each end. The slots 22 and 24 allow for adjustability of the half socket portions to accommodate differences in stringer width and plank thickness.

The lower end of the support portion 10 of the temporary bracekt A is formed with the slot 34 which receives the first trunnion shaft 36 affixed to the end of the float in the form of drum D. The drum D is also provided with a second trunnion 38 for the slot **34*a*** of the companion bracket B.

The second or companion float support in the form of temporary bracket B is identifical to bracket A with identical parts bearing the same reference numeral but accompanied by a lower case letter *a.*

The dock section S is conventional and is made up to the outside 2×4 stringers W and Wa to which are secured the cross planks P. The planks P are further rigdified by securing the same to the central 2×4 stringer 40. The secured to the outer end of each of the stringers W and Wa may by means of a 42 through a hole in the stringers is a conventional dock bracket 33. The dock brackets 33 and **33*a* receive and are secured to the posts P by the set screws 52 particularly as in FIGS. 1, 5 and 6. The inner end of each stringer W and Wa is formed with the hole 48, FIG. 1, for securement to a support member in one form of a dock bracket 33*a* thereto particularly as illustrated in FIGS. 1 and 5** and described hereinafter.

OPERATION

With the dock section S constructed and having a bracket 33 on the outer of each stringer W, the brackets A and B are secured to the stringers W and Wa by positioning the half portions of the brackets in clamping engagement with a stringer at a point slightly removed from the dock brackets 33, particularly FIGS. 1 and 5. The wing nuts are then tightned thereby securely clamping the brackets to the stringers. There is adjustment in the clamping engagement due to the slots 22 and 24. The operator then stands on the end of previously installed beginner dock section such as Sa or a support platform on the edge of the water and manipulates the float in form of drum D in the water and the brackets to engage the trunnion shafts 36 and 38 of the drum into the slots 34 and 34*a* of the brackets thereby releasably engaging the drum with the dock section.

the operation O then extends the dock section to the position shown in FIG. 1 with the outer end being floatingly supported by the drum D and inner end held by the operator.

The operator then lowers the inner ends of the stringers W and W*a* onto the support dock brackets 33*a* on the end of the intial dock section Sa and nut-equipped bolts are secured through the holes 48 of the stringers and the hole 35 of each of the dock brackets 33*a* on the dock section S*a* thereby securing the dock section S to section S*a* with the outer end of the section S floatingly supported by the drum D as illustrated particularly in FIG. 5.

With the dock section so positioned and secured, the operator then walks out on the section to a point adjacent the brackets A and B and slips a dock post P downwardly through each permanent dock bracket 33 on the ends of the stringers and into the bottom of the water. Each post is then driven into the bottom of the lake sufficiently to make it solid. The set screw 52 on each dock bracket is then tightened against the post in the bracket 33 which secures the dock section to the posts parallel to the water. The drum D is then no longer necessary to support the section and is pushed downwardly sufficiently in the water so that the trunnions of the drum are disengaged from the slots 34 and 34*a* of the respective brackets A and B, and th drum then floated away from the brackets. The brackets are then removed from the dock section, and the dock section is in usaable secured position without the operator having gone into the water.

A further identical section of dock is installed and connected to the section S by connecting brackets A and B to the further section and repeating the above mentioned procedure, again without getting into the water. It will be seen that all that is needed to install any number of dock sections with conventional dock brackets 33 on one end is one pair of brackets A and B, the drum D, and the necessary dock posts. There is no need for costly metal stringer-frames for each section which must remain with and support each dock section as in presently known dock construction.

It will be seen that relative to FIG. 5 in particular, with the dock section S connected to support brackets 33*a* of section S*a*, brackets 33 and and 33*a* connected to posts P and P*a*, the brackets A together with drum D may be removed from the dock section S. What remains is the dock section S completely installed without going into the water.

After a dock is installed the same may be removed without getting into the water by using the same brackets A and B and the drum D in the following manner. The brackets are attached to the stringers W and W*a* adjacent the dock brackets as previously described. Then the drum D is placed with the trunnions 36 and 38 engaged in the slots 34 and 34*a* as in FIGS. 2 and 5. Then the operator loosens the set screws 52 of the dock brackets with the dock section being supported by the drum D and as a result, the dock posts may be removed by the operator standing on the end of the dock section, for the outer end of the dock section is supported by the drum. With the dock posts removed, the operator stands on the dock section S*a* and disconnects the inner ends of the stringers W and W*a* from the dock brackets 46 on the section S*a*. The operator then grasps the stringers W and W*a* as in FIG. 1 and moves the section and drum engaged therewith to a point alongside the dock section S*a* and removes the section S from the drum. He then removes the bracket A and B from the section S and uses the same brackets to remove another dock section in the same manner. It will be seen that with the brackets A and B easily stored there are no expensive metal frames to weather if not stored. The only items that will weather if not stored are the dock brackets 46 and the dock sections S which are generaly stored in the open anyway.

I claim:

1. A mechanism for installation and removal of a dock section having permanent brackets secured thereto for engagement with dock posts including a. a pair of temporary brackets, b. means for releasably connecting said temporary brackets to a dock section adjacent one end thereof, c. means for releasably engaging the free end of the temporary brackets to a float for supporting the dock section at one end upon the water, d. means on the other end of the dock section for connection with a support, e. means for connecting the permanent brackets secured to the dock section to dock posts for permanently supporting the dock section on the dock posts and support whereby the temporary brackets and float are released from the dock section.

2. The method of intalling a section of dock in the water without getting into the water consisting in releasably attaching a temporary bracket to each side of the dock section adjacent the outer end thereof, then releasably engaging said temporary brackets with a float thereby supporting the outer end of the dock section on the float, then securing the inner end of the dock section on a support, then driving a post into the bottom of the water adjacent the outer end of each side of the dock section, then securing the outer end of the said dock section to the posts, them removing the float from the temporary brackets and the temporary brackets from the dock section thereby leaving the section of dock supported at the inner end by the support with the outer end supported by the dock posts.

3. A dock section and apparatus for installation thereof on the bottom of a body of water and extended over the water and from removal from the bottom comprising:

a. a dock section including platform members connected to b. longitudinal spaced stringer members, c. a temporary bracket for each stringer member, d. means on each temporary bracket for removably connecting the same to the dock section adjacent one end there of and extending substantially at a right angle thereto, e. means on the other end of the dock section for connection with a support, f. means on each temporary bracket for releasable engagement with the trunnions of a float for temporarily supporting the end of the dock section upon the water, g. permanent brackets connected to said dock section with means for receiving and securement with dock posts driven into the bottom of the water perpendicular thereto while the dock section is supported by the support and float thereby allowing removal of the float and the temporary brackets from the dock section with the dock section installed in the water on the dock posts and the support.

4. The device of claim 3 in which said means on each temporary bracket for removably connecting the same to one end the dock section includes a clamp.

5. The device of claim 4 in which said means on each temporary bracket for releasable engagement with a float includes a slot for receiving a trunnion of the float.

6. The device of claim 3 in which said means on each temporary bracket for releasable engagement with a float includes a slot for receiving a trunnion of the float.

7. A dock section and apparatus for installation on the bottom of a body of water and extended over the water and from removal from the water comprising:

a. a dock section, b. a pair of temporary brackets, c. means on said temporary brackets for removably connecting the same to the dock section adjacent one end thereof, d. a float, e. means for removably connecting said temporary brackets to said float for temporarily supporting the end of the dock section upon the water, f. means on the other end of the dock section for connection with a support, g. permanent brackets connected to said dock section with means for receiving and connection with dock posts driven into the bottom of the water perpendicular thereto while the dock section is supported by the float thereby allowing removal of the flot and the temporary brackets from the dock section with the dock section installed in the water on the dock posts and the support.

* * * * *